US005259433A

United States Patent [19]

Cloutier

[11] Patent Number: 5,259,433

[45] Date of Patent: Nov. 9, 1993

[54] DOOR COUNTERWEIGHT SYSTEM

[76] Inventor: Hermel Cloutier, Brodie Drive, Concession 6, R. R. #4, Orillia, Ontario, Canada, L3V 6H4

[21] Appl. No.: 867,459

[22] Filed: Apr. 13, 1992

Related U.S. Application Data

[63] Continuation-in-part of Ser. No. 507,754, Apr. 12, 1990, Pat. No. 5,103,890.

[30] Foreign Application Priority Data

Dec. 21, 1989 [CA] Canada ..... 2006373

[51] Int. Cl.[5] ..... E05F 11/00

[52] U.S. Cl. ..... 160/190; 160/193

[58] Field of Search ..... 160/201, 190, 193, 189, 160/133, 1, 4, 9

*Primary Examiner*—David M. Purol

*Attorney, Agent, or Firm*—Hoffman, Wasson & Gitler

[57] ABSTRACT

An overhead door system employs counterweights which operate through cables connected to a drum which tapers from one end to the other so that the effective force acting on the door in the opening direction is reduced as the proportion of the weight of the door to be supported reduces. The system is adjustable readily to accommodate different types of doors having different opening characteristics in terms of the proportion of the doors weight that must be counterbalanced at different stages of the door opening movement. The drum has a pair of continuous grooves extending side-by-side throughout its length, the counterweight being independently supported by each of a pair of cables laid in these grooves.

18 Claims, 5 Drawing Sheets

DOOR COUNTERWEIGHT SYSTEM

CROSS REFERENCE TO RELATED APPLICATION

This is a Continuation-in-Part of my copending U.S. patent application No. 07/507,754 filed Apr. 12, 1990 now U.S. Pat. No. 5,103,890.

BACKGROUND OF THE INVENTION a) Field of the Invention

This invention relates to a new or improved drum for use in a counterbalance system for overhead doors, and to a system and door installation employing such drum.

b) Description of the Prior Art

Over the years, numerous designs of counterbalance systems for upwardly opening or overhead doors have been devised, and examples are shown in various prior patents, such as U.S. 1,469,542 Storms, U.S. 1,603,379 Dautrick and U.S. 3,094,163 Herber, and more recently, an earlier design of my own shown in U.S. 4,887,658. The door opening arrangements disclosed in the foregoing patents make use of weights to provide the counterbalance force required during door opening. Door opening systems employing springs to provide the counterbalance force are well known, and are widely used, particularly in domestic garage doors.

Various forms of torsion or tension springs may be employed utilizing systems of cables and pulleys to transmit the spring force to the door. Spring operated counterbalance systems for doors tend to be troublesome to install, and while such systems are often not unduly expensive, they can be troublesome from the point of view of maintenance, and are subject to failure, for example through fracture of a spring or the like. Furthermore, with spring counterbalance systems it is difficult if not impossible to ensure that the spring force is accurately matched to the door load throughout the range of door opening movement.

SUMMARY OF THE INVENTION

The present invention provides a counterbalance system for an overhead door, such door being adapted for installation in a doorway to be movable from a closed position wherein it is arranged in a generally vertical orientation closing the doorway and an open position wherein it is disposed above the doorway and at least partially horizontally oriented, guide means for acting between the lateral edges of the door and the sides of the doorway to guide the door in its movement between open and closed positions, said counterbalance system comprising: a spool adapted to be rotatably mounted on structure surrounding the doorway and a first cable connected between said spool and said door such that rotation of said spool in a direction to wind the cable onto the spool applies through said first cable a force urging the door to move in the opening direction, the weight of the door as it moves away from the closed position being supported initially by said first cable and subsequently to an increasing extent by said guide means as the door moves towards the fully open position; a winding drum fixed to rotate with said spool said drum comprising: a hub defining therein a longitudinal axis and an axial bore extending through said drum, said drum having an outer periphery configured with a pair of adjacent continuous peripheral grooves extending generally helically thereon and progressing from one end of the drum to the other; said drum defining successively in the axial direction: a first region wherein said pair of grooves defines a plurality of turns about the axis at a constant radius; and a second region wherein the radius of said grooves from said axis increases progressively from said constant radius to a maximum radius that is at least about twice said constant radius; a pair of elongate flexible load transmitting elements connected to said drum and laid in respective ones of said pair of grooves to unwind from said drum as said spool rotates to wind the cable thereon, and vice versa; said force-transmitting elements freely suspending a counterweight such that the mass thereof provides a torque acting on said drum, said spool, and said first cable to urge said door in the opening direction, said torque having a magnitude that is proportional to the radius from said axis of the point on said drum at which said pair of force transmitting elements part from their respective continuous peripheral grooves; wherein said counterweight is independently suspended by each of said force transmitting elements such that in the event of failure of one of said force transmitting elements it will remain suspended by the other.

The spool and the drum may be separate elements each attached to a shaft that is mounted to rotate at the top of the doorway, a drum and a spool being positioned in proximity to each edge of the doorway. Alternatively the spool and drum may be integral with each other and/or with the shaft. The force transmitting element may be a pair of second cables that either support the counterweight directly, or which are each formed in a loop having one end anchored to the door frame, the counterweight being carried by a pulley that is supported in both the loops.

The invention also provides for use in a counterbalance system for a vertically movable door, a drum comprising a hub defining therein an axial through bore, said drum having an outer periphery configured with a pair of adjacent continuous grooves extending generally helically thereon and progressing from one end of the drum to the other, the drum having a central axis and defining in the axial direction a first region wherein said pair of grooves define a plurality of turns about axis at a constant radius; and a second region wherein the radius of said pair of grooves from said axis increases progressively from said constant radius to a maximum radius that is of the order of at least twice said constant radius.

Preferred embodiments of the invention as disclosed herein provide a door counterbalance system that is particularly easy to install, and that also affords a ready means of adjustment upon installation to achieve accurate counterbalancing. The disclosed counterbalance system is relatively cheap, and is safe and highly reliable in operation. The basic counterbalance system is readily adaptable to accommodate various types of overhead doors whether they be standard lift, high lift, or even vertical lift.

Preferably there are three turns of the pair of grooves at said minimum (constant) diameter, and five or six turns at said maximum diameter. The drum is suitable for use with standard lift doors using the grooves essentially only up to the end of the intermediate section. For high lift doors, a length of the grooves at said maximum diameter is used, this length corresponding to the vertical lift section of the door opening movement. For purely vertical lift doors, only the maximum diameter region of the grooves is used.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
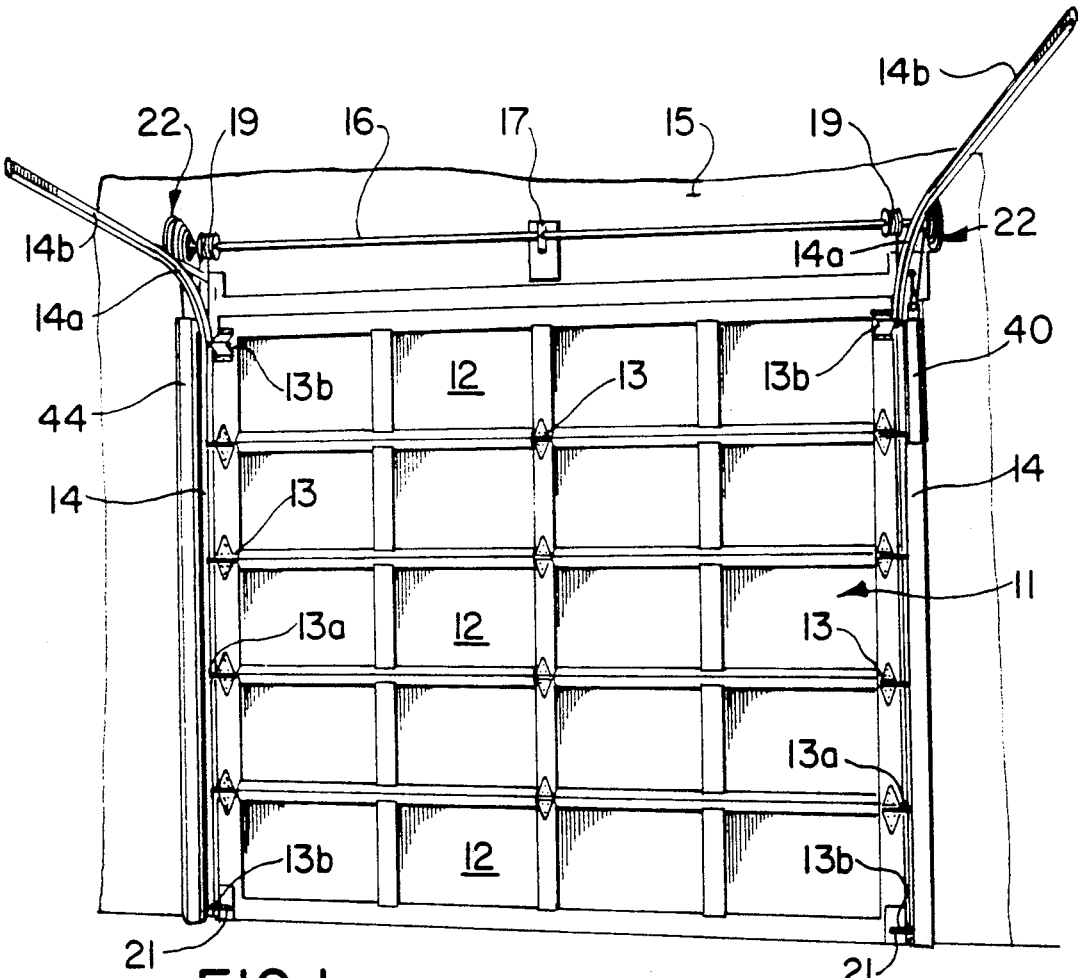
FIG. 1 is an overall perspective view from the inside of a building showing a preferred embodiment of an overhead door counterbalance system in accordance with the invention.

As shown in FIG. 1, an overhead garage door 11 is formed by a series of horizontally divided sections 12 pivotally interconnected by hinges 13. At each edge of the door the hinges carry a laterally projecting hinge pin 13*a* which in known manner supports a roller or the like (not shown) received within a track structure 14 mounted in the door frame 15 at each side of the doorway and adapted to guide movement of the door sections during opening and closing. As shown, the tracks 14 are vertically arranged and extend at their upper ends through a curved intermediate section 14*a* into a generally horizontal top section 14*b* that projects away from the doorway, the top sections being supported by any suitable means, e.g. hangers attached to a ceiling (not shown). The upper edge of the top door section and the lower edge of the bottom door section likewise carry laterally projecting pins 13*b* carrying guide means such as rollers 8 (see FIG. 3) which cooperate with the track 14.

Extending horizontally above the doorway is a shaft 16 rotatably carried in a central bearing 17 and in two lateral bearings 18 (see FIG. 3) adjacent opposite side edges of the door.

Figure 3:
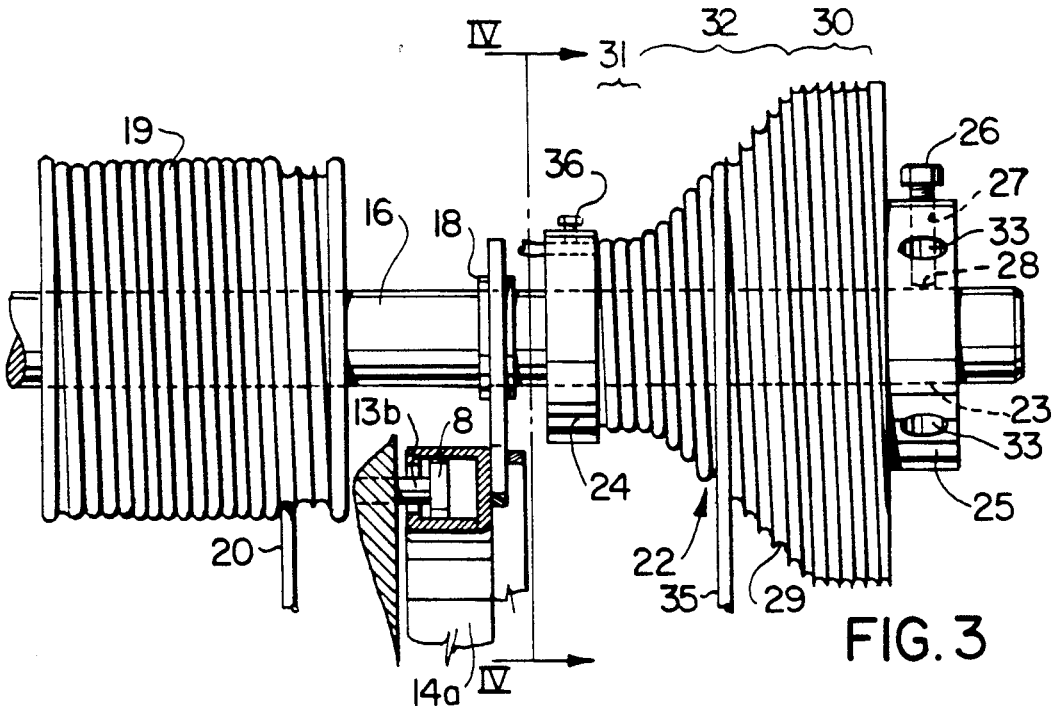
FIG. 3 is an elevational view to a larger scale showing an important part of the counterbalance system.
Figure 4:
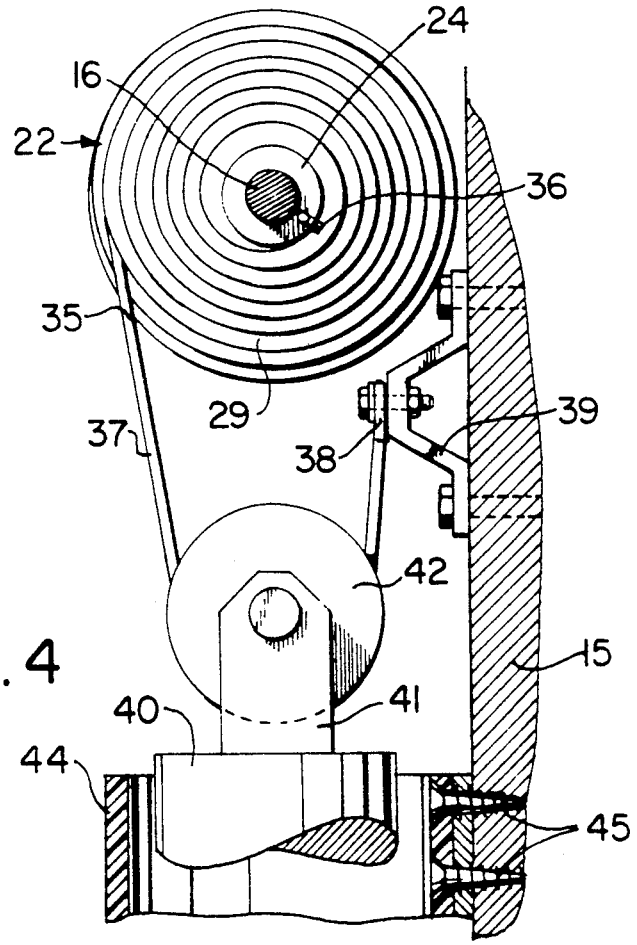
FIG. 4 is a fragmentary view taken in the direction indicated by the arrows IV—IV in FIG. 3.

Close to each end of the shaft 16 and fixed to rotate with it is a flanged cylindrical spool 19 positioned substantially in alignment with the lateral edge of the door. A cable 20 is wound on this spool and extends vertically downwards being attached at its end to a bracket 21 at the lower corner of the bottom door section. On the opposite side of the bearing 18 the shaft 16 carried a drum assembly 22 which is best seen in FIGS. 3 and 4. The drum 22 has an axial bore 23 extending therethrough between a flange 24 at one end and a collar 25 at the other. A clamping screw 26 is threaded in a radial through bore 27 in the collar 26 and can be tightened to engage its tip 28 against the surface of the shaft thereby fixing the drum 22 to rotate with the shaft. Between the flange 24 and the collar 25, the drum is of generally frusto-conical outline defined by a continuous groove 29 that extends in a spiral/helical manner from a small diameter end adjacent the flange 24 to a larger diameter end adjacent the collar 25. The radius of the groove 29 from the axis of the shaft 26 is at a maximum adjacent the collar 25, and remains constant for about 5 or 6 turns as indicated by the region 30. Adjacent the flange 24 there is a region of minimum diameter 31 extending for about 3 turns, and between these two regions is an intermediate region 32 wherein the radius of the groove changes in a continuous manner.

A cable 35 is wound onto the drum in the groove 29, one end of the cable being attached to the flange 24 by means of a grub screw 36, the cable then being laid into the groove 29 to an extent corresponding to the rotational position of the drum 22. From the drum the cable 35 descends in a loop 37 and has its opposite end 38 attached to a bracket 39 mounted on the door frame 15. An elongate counterweight 40 has a clevis 41 attached to its upper end and providing a bearing for a grooved pulley wheel 42 which runs on the cable loop 37.

Four radially extending cylindrical sockets 33 are provided spaced at 90° intervals around the periphery of the collar 25.

As shown particularly in FIGS. 1 and 4, a tubular guide housing 44 is vertically arranged adjacent each edge of the door frame 15 and is attached thereto e.g. by wood screws 45. The housings 44 guide the counterweights 40 for vertical movement therein. In addition, the housings 44 provides protection for the counterweights to ensure that their movement is unimpeded, and protect the users from inadvertent contact with the counterweights.

Figure 2:
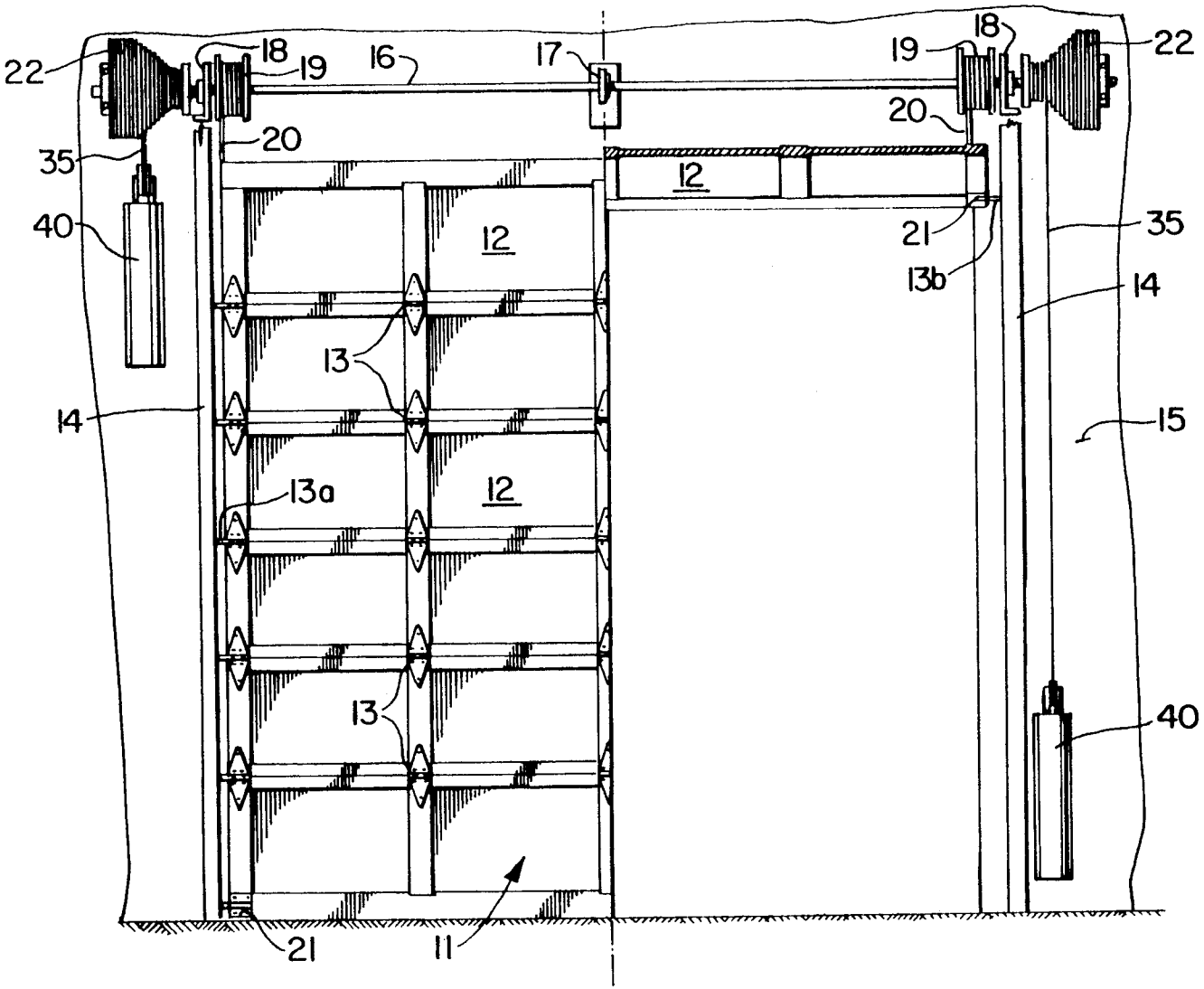
FIG. 2 is an elevational view of the door and counterbalance system with parts omitted for reasons of clarity, the door being shown in different positions in the left and right hand side of the figure.

As will be appreciated from the foregoing description, as the door 11 is moved from its closed position shown in FIG. 1 shown in the left hand side of FIG. 2, to its opened position as shown in the right hand side of FIG. 2, the door sections 12 guided by their pin mounted rollers 8 in the tracks 14, moves successively from the vertical position, around the curved track sections 14, into a substantially horizontal position wherein they are supported by the top portions 14*b* of the guides. During this movement the weight of the door 11 is substantially counterbalanced by the counterweights 40 so that the effort required to move the door from its closed to its opened position is minimal. Furthermore, this effort does not vary substantially throughout the range of opening movement of the door. This effect is achieved by careful selection of the configuration of the drums 22 and the mass of the counterweights 40 in relation to the weight of the door and the diameter of the spools 19. Thus, for example, for a door 11 having a weight of say 200 pounds, each counterweight system must provide a counterbalance force of up to 100 pounds, and this force must diminish in proportion to the increasing proportion of the weight of the door that is supported by the horizontal top sections 14*b* of the track.

When the door is in the closed position as shown in the left hand side of FIG. 2, the cable 35 is wound onto the drum 22 as far as the maximum diameter region 30 of the groove 29. At this location, the lifting force applied to the cable 20 as a result of the mass of the counterweight 40 will be a function of the ratio of the spool diameter 19 to the diameter of the region 30 of the drum groove. As shown, this ratio is approximately 2:1, and therefore two counterweights 40 of mass 100 pounds each will provide sufficient force to counterbalance the full weight of the door.

As the door is opened, the cable 35 unwinds from the drum groove 29 at a progressively decreasing radius, and therefore the torque applied to the shaft 16 also progressively decreases until the minimum-radius groove region 31 is reached, at which location the cable leaves the drum at a radius very much less than the radius of the spool 19, so that the torque applied to the shaft 16 is correspondingly reduced as the door approaches its fully opened position and substantially its entire weight is supported by the top track portions 14*b*.

Adjustment of the counterbalance force can be effected quite easily if it is necessary to make slight changes to more closely match this force to the manner in which the effective weight of the door is reduced during opening. To do so, when the door is in the fully closed position, a torque bar or the like implement (not shown) can be inserted into one of the sockets 33 in the drum collar 25 and used as a torque arm to support the drum 22 against rotation under the force of the counterweight, whereupon the screw 26 can be slackened, freeing the drum relative to the shaft. The drum can therefore be rotated under control of the torque bar to vary the extent to which the cable 35 is unwound from the drum, and thus vary the torque applied to the shaft 16 through the counterweight, with the door 11 in its fully closed position. When the desired position of angular adjustment of the drum 22 has been reached, the screw 26 is re-tightened to once again clamp the drum to the shaft.

Likewise, upon installation of the counterbalance system, the counterweight 40 may simply be placed in position as shown at the right hand side of FIG. 2 and supported on a block or the like. With the shaft 16 and its spools 19 and drums 22 mounted as shown, the cable 35 can be attached to the flange 24 and wound around one or two turns of the drum, thereafter being passed downwardly around the pulley 42 and looped back to the mounting bracket 39. With the clamping screw 26 slackened, the torque bar can thus be used to rotate the drum 22 winding the cable onto it and thereby raising the counterweight 40. When the counterweight has been raised to the desired position, the screw 26 is tightened to clamp the drum to the shaft.

Figure 5:
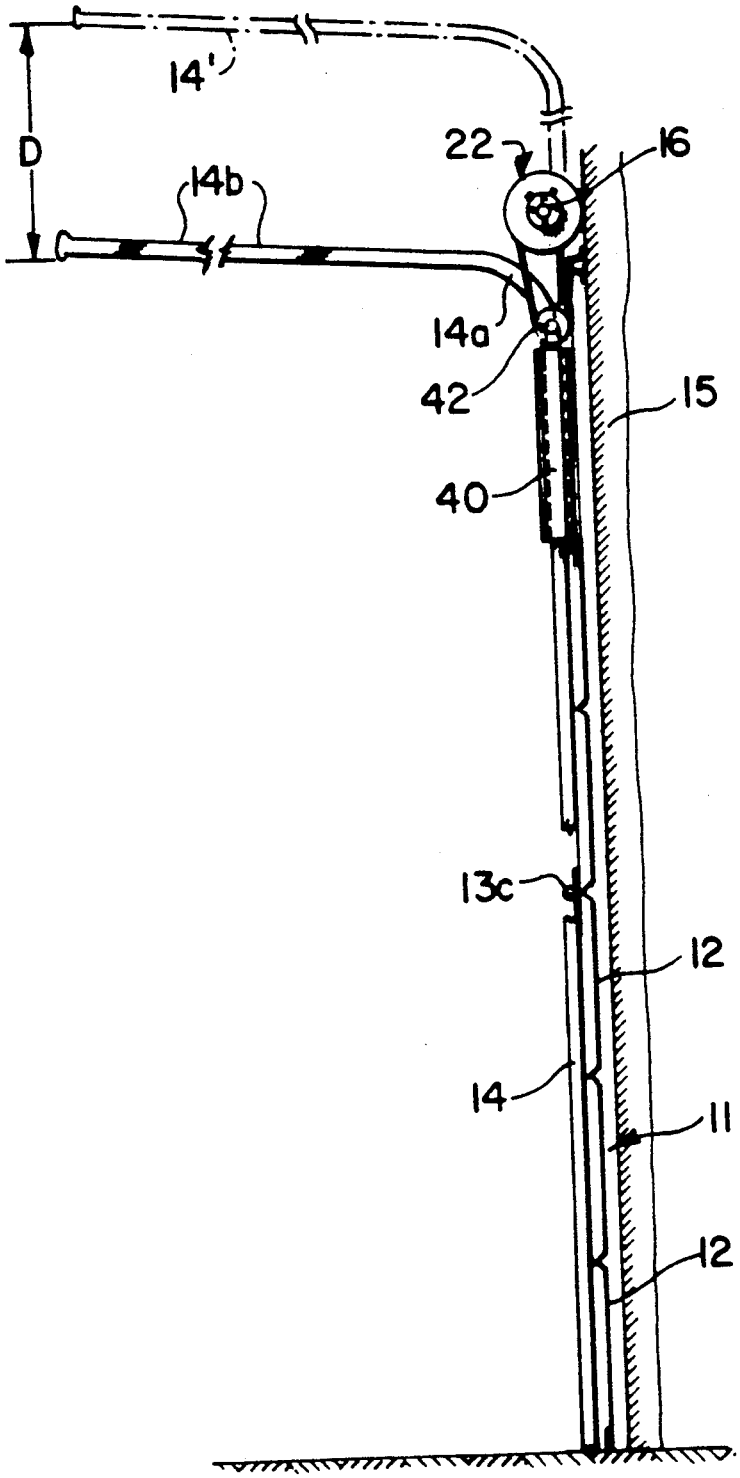
FIG. 5 is a side elevational view of the door counterbalance system.

The counterbalance system can readily be adapted for use with what are referred to as "high lift" doors, i.e. doors which upon opening initially travel vertically for a substantial distance before the door sections start to turn into the horizontal position. In such applications a track such as that shown in broken lines at 14' (FIG. 5) is utilized. It will be seen that as compared with the earlier described embodiment, in this configuration the door must be raised vertically by a distance D before the door sections start to swing out of the vertical position. This is readily accommodated by the counterbalance system shown since all that is necessary is to wind the cable 35 around the maximum diameter region of the groove 29 over a length corresponding to D. When the system is thus configured, it will be appreciated that, moving from the closed position, over the initial opening distance D, the torque applied to the drum 23 to the cable 35 will be constant, as also will be the counterbalance force applied to the door through the cables 22. This is necessary since during the initial distance D from the closed position, the entire weight of the door is supported by the cables 20.

It will be seen that with the cable 35 forming a loop 37 as shown in FIG. 4, the vertical movement of the counterweight 40 will equal approximately ½ of the length of cable unwound from the drum. It would be possible to dispense with the loop 37 and suspend the counterweight 40 directly on the cable 35. In this arrangement the full mass of the counterweight would be applied to the cable 35, but of course the vertical movement of the counterweight would correspond exactly in length to the length of cable unwound, and during unwinding, the counterweight would be subjected to greater lateral movement. The effect of lateral movement would however be rather minimal and could easily be absorbed by the guide housing 44. The guide housing could conveniently be made of a plastic tubing, e.g. of PDC, so that minimal frictional forces would be encountered.

As compared to the arrangement shown, the arrangement discussed whereby the counterweight 40 is attached directly to the cable 35 would enable one to use a counterweight that is half the mass of the counterweight 40, or alternatively would enable one to use a drum having a maximum diameter of the groove 29 approximately ½ of the diameter shown in FIG. 3.

Figure 6:
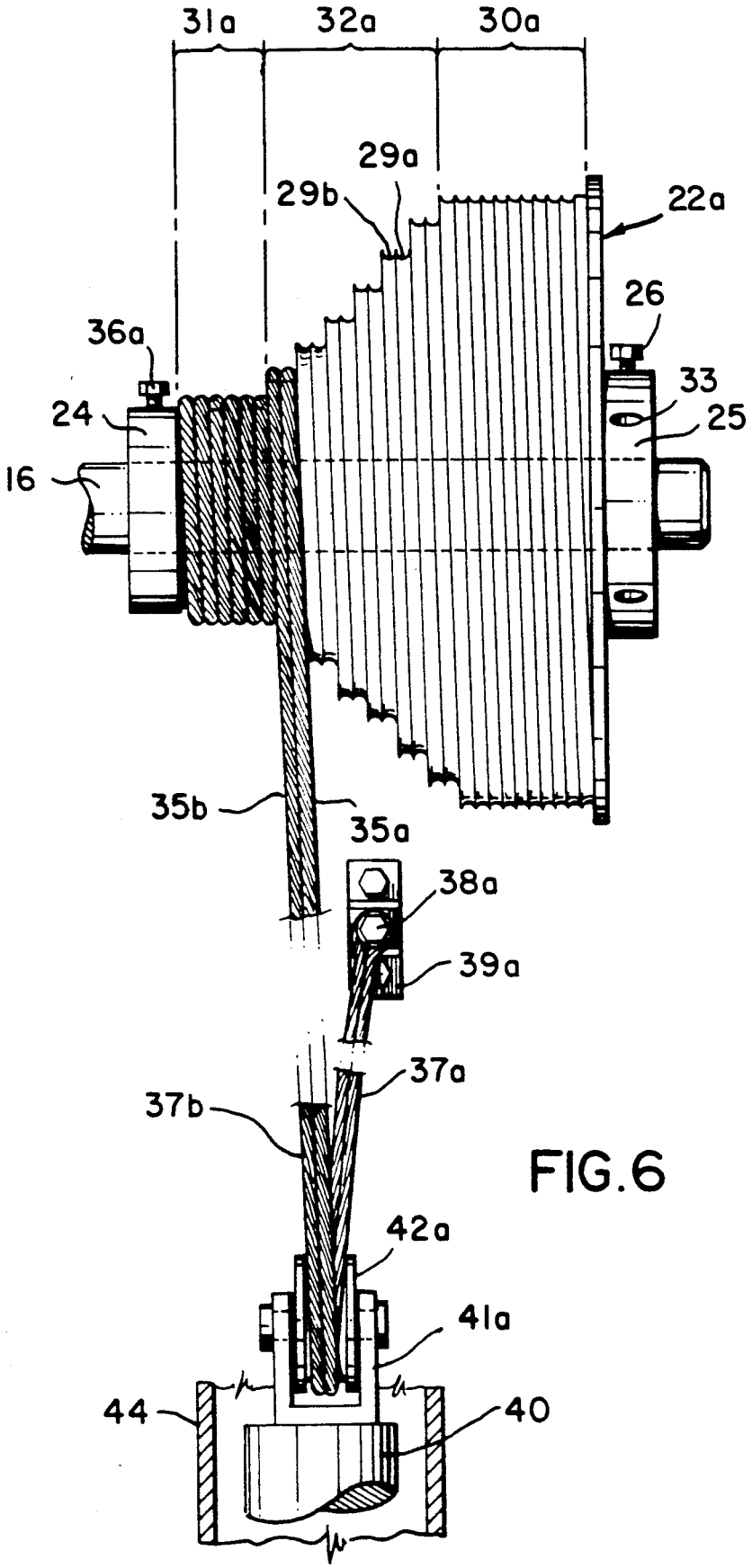
FIG. 6 is view corresponding in part to FIG. 3 showing a modified counterbalance system.

A modified embodiment of the counterweight system is shown in FIG. 6 wherein like reference numerals are used to identify like parts already referred to in FIGS. 1 through 5. The drum assembly as shown in FIG. 6 differs from that shown in the previous figures in that a pair of continuous grooves 29*a*, 29*b* are provided. These grooves lie side-by-side, each being identical in length and configuration. As before, the grooves 29*a*, 29*b* each extends continuously through a region 30*a* of large diameter wherein there are five or six turns of the grooves 29*a*, 29*b* at a constant radius; a region 31*a* of minimum radius wherein there are about three turns of the grooves 29*a*, 29*b* at a minimum radius; and an intermediate region 32*a* wherein the radius of the grooves 29*a*, 29*b* increase smoothly and continuously from the region 31*a* to the region 30*a*.

As before, the drum assembly 22*a* is releasably fixed to the shaft by a clamping screw 26 carried in a collar 25, the collar including sockets 33 for engagement by a torquing tool such as a rod to effect rotation of the drum assembly 22*a* relative to the shaft when the clamping screw 26 is disengaged.

At the opposite end of the drum there is a flange 24 provided with a clamping element 36*a*. The ends of a pair of cables 35*a*, 35*b* are releasably fastened to the drum assembly 22*a* by means of the clamping element 36*a*, these cables being laid side-by-side in their respective grooves 29*a*, 29*b* in essentially the same manner as described in relation to the cable 35 in FIGS. 3 and 4. From the drum assembly 22*a* the cables 35*a*, 35*b* hang in loops 37*a*, 37*b*, the opposite ends of the cables being secured at 38*a* on a bracket 39*a* fixed to a wall adjacent the doorway. The loops 37*a* and 37*b* pass around respective grooves of a pulley 42*a* rotatably mounted in a clevis 41*a* attached to the upper end of an elongate counterweight 40. As before, the counterweight is positioned within a vertical tubular casing or guide 44 that is fixedly mounted adjacent the doorway.

During operation, the arrangement of FIG. 6 functions similarly to that described in relation to FIGS. 1 through 5. However the replacement of the single weight support cable 35 by a pair of twinned weight support cables 35*a* and 35*b* as in FIG. 6 offers significant advantages in respect of performance, reliability, and safety.

With the arrangement as described in FIGS. 1 to 5 where there is a single weight supporting cable at each side of the door, the failure of either cable can have serious consequences if it occurs while the door is in the opened position. Such failure will result in the counterbalance force acting on the door being reduced in half so that the door will descend. The speed of such descent may be such as to cause injury to individuals or damage to the door. If the door is of heavy construction as in some industrial applications, serious damage may result. At the same time the counterweight 40 will be released and will plunge to the bottom of the guide housing 44, and while this is unlikely to cause any damage, there would still be the inconvenience of reengaging the counterweight to a replacement cable 35.

These difficulties are completely eliminated with the double cable arrangement described in relation to FIG. 6. Each of the cables 35*a*, 35*b* of course is itself of sufficient strength to easily support the counterweight 40, so that in the event that one of the cables should fail, no untoward effect will result since the remaining cable will control the movement of the door. Thus potential damage to the door or to individuals through unplanned descent of the door is eliminated. Instead, the door will function normally until the broken cable 35*a* or 35*b* can be replaced. It will be appreciated that replacement of one or other of the cables 35*a*, 35*b* can be effected with minimal interruption in the operation of the door so that the down time that would occur in replacement of a cable 35 in the system of FIGS. 1 through 5 is avoided. The ease of cable replacement can be improved if there is a separate clamping screw 36*a* and separate attachment 38*a* for each of the cables 35*a*, 35*b*. Thus to replace a broken cable, the ends of it are removed from the clamping screw 36*a* and the attachment 38*a*, and a replacement cable is then attached to the drum at 36*a*, wound around the drum and laid in the appropriate groove 29*a*, 29*b* to the same extent as the unbroken cable, passed in a downwards loop around the pulley 42*a* and, after being cut to the same length as the unbroken cable, connected at 38*a* to the bracket 39*a*.

Thus the arrangement of FIG. 6 represent a significant improvement in the safety of counterbalance systems for overhead door installations. Each of the two cables 35*a*, 35*b* will be subjected to lower stress, and the door operating system will be protected from damage since even in the event of failure of one of the cables, it will not be subjected to sudden jerks or impact loads. The improvements inherent in this system should represent a significant saving in terms of maintenance costs for door counterweight systems. The operational reliability of the improved system may be a crucial factor in some installations, e.g. in buildings where emergency vehicles such as fire engines or ambulances are garaged. In those installations the delayed response time which could result through failure of a door to function reliably could well contribute to loss of life.

What I claim as my invention is:

1. A counterbalance system for an overhead door, such door being adapted for installation in a doorway to be movable from a closed position wherein it is arranged in a generally vertical orientation closing the doorway and an open position wherein it is disposed above the doorway and at least partially horizontally oriented, guide means for acting between the lateral edges of the door and the sides of the doorway to guide the door in its movement between open and closed positions, said counterbalance system comprising:

a spool adapted to be rotatably mounted on structure surrounding the doorway and a first cable connected between said spool and said door such that rotation of said spool in a direction to wind the cable onto the spool applies through said first cable a force urging the door to move in the opening direction, the weight of the door as it moves away from the closed position being supported initially by said first cable and subsequently to an increasing extent by said guide means as the door moves towards the fully open position;

a winding drum fixed to rotate with said spool and comprising: a hub defining therein a longitudinal axis and an axial bore extending through said drum, said drum having an outer periphery configured with a pair of adjacent continuous peripheral grooves extending generally helically thereon and progressing from one end of the drum to the other;

said drum defining successively in the axial direction:

a first region wherein said pair of grooves defines a plurality of turns about the axis at a constant radius; and a second region wherein the radius of said grooves from said axis increases progressively from said constant radius to a maximum radius that is at least about twice said constant radius;

a pair of elongate flexible load transmitting elements connected to said drum and laid in respective ones of said pair of grooves to unwind from said drum as said spool rotates to wind the cable thereon, and vice versa;

said load-transmitting elements freely suspending a counterweight such that the mass thereof provides a torque acting on said drum, said spool, and said first cable to urge said door in the opening direction, said torque having a magnitude that is proportional to the radius from said axis of the point on said drum at which said pair of force transmitting elements part from their respective continuous peripheral grooves;

wherein said counterweight is independently suspended by each of said force transmitting elements such that in the event of failure of one of said force transmitting elements it will remain suspended by the other.

2. A counterbalance system as claimed in claim 1 wherein said drum includes a third region wherein said pair of grooves continue at said maximum radius through a plurality of turns about said axis.

3. A counterbalance system as claimed in claim 1 wherein said drum has associated therewith winding means comprising a plurality of formations that define locations that are angularly spaced about the axis of said drum, said formations being selectively engageable at each said location by a torquing tool by means of which the drum can be rotated about said axis.

4. A counterbalance system as claimed in claim 1 wherein said drum and said spool are carried on a shaft for mounting to rotate at the top of the doorway, said drum being positioned in proximity of one edge of the doorway, said load transmitting elements comprising a pair of cables attached to the drum in said first region and laid side-by-side in said pair of grooves and extending from said drum each in a depending loop that has an opposite side supported on a fixed mounting and the counterweight being suspended from a pulley carried by said loops.

5. A counterbalance system as claimed in claim 4 further including a second drum wherein each of said drums is provided at opposite ends of said shaft, each of said drums having an associated pair of cables extending in a depending loop and suspending a respective counterweight.

6. A counterbalance system as claimed in claim 1 including a tubular housing vertically positioned to surround and enclose said counterweight during vertical movement thereof.

7. For use in a counterbalance system for a vertically movable door, a drum comprising a hub defining therein an axial through bore, said drum having an outer periphery configured with a pair of side-by-side continuous grooves extending generally helically thereon and each progressing from one end of the drum to the other, the drum having a central axis and defining in the axial direction a first region, wherein said pair of grooves define a plurality of turns about said axis at a constant radius, a second region wherein the radius of said pair of grooves from said axis increases progressively from said constant radius to a maximum radius that is of the order of at least twice said constant radius and a third region wherein said pair of grooves continue at said maximum radius through a plurality of turns about said axis, said drum comprising only said first region, said second region and said third region, said drum further being adapted to have laid side-by-side in said pair of grooves a pair of cables, said drum having attachment means thereon for affixing corresponding ends of said pair of cables to the drum in the vicinity of that end of said first region that is furthest from said second region.

8. A drum as claimed in claim 7 wherein the length of said pair of grooves at said maximum radius corresponds to the length of said pair of grooves through said second region.

9. A drum as claimed in claim 7 wherein said hub carries means for forming a driving engagement with a shaft passed through said axial bore.

10. A drum as claimed in claim 9 wherein said means comprises a radially extending clamping screw threadedly engaged in a bore in said hub that a tip of said clamping screw can be extended into said axial bore.

11. A drum as claimed in claim 7 including receiving means to accept a torque arm at a plurality of positions angularly spaced about said axis, whereby said drum can be rotated by means of a torquing tool engaged with any of said receiving means.

12. A drum as claimed in claim 7 including clamping means for releasably clamping said drum to a shaft passing through said axial bore, and receiving means for cooperation with a torquing tool to effect angular rotation of said drum about such shaft when said clamping means is released.

13. A drum as claimed in claim 7 wherein said drum defines a third region wherein said pair of grooves continue at said maximum radius through a plurality of turns about said axis, said hub carrying means for forming a driving engagement with a shaft passed through said axial bore, and receiving means to accept a torque arm at a plurality of positions angularly spaced about said axis, whereby said drum can be rotated by means of a torquing tool engaged with any of said receiving means.

14. A drum as claimed in claim 12, wherein said receiving means is formed on a collar that is integral with said drum and comprise a plurality of bores in said collar extending in a radial direction.

15. A winding drum for use in a counterbalance system for an overhead door installation of the type that has door sections guided in tracks at their opposite edges to move upwardly from a closed position to an open position, the weight of the door being balanced throughout the opening movement by a counterweight suspended on cable means wound on the drum, wherein said winding drum comprises:

a body having an axial bore adapted to receive a shaft;

said body being defined by an outer periphery only having axially adjacent first, second and third regions, said outer periphery configured with a pair of adjacent continuous grooves extending generally helically thereon around the axis of said bore and progressing from one end of the drum to the other through all of said regions;

said pair of grooves extending side-by-side and in said first region defining a plurality of turns at constant radius about said axis, in said second region defining a plurality of turns the radius of which increases progressively from said constant radius adjacent said first region to a maximum radius that is of the order of at least twice said constant radius, and in said third region in which a said pair of grooves continue at said maximum radius throughout a plurality of turns about said axis;

whereby in use a pair of cables can be laid side-by-side in said pair of grooves and upon rotation of said drum will wind on or off in unison, the effective torque applied to said drum by the counterweight suspended on said cables varying according to the point at which the cables disengage from the drum.

16. A winding drum as claimed in claim 15 wherein the rate of increase of the radius of said pair of grooves is substantially constant throughout the length of said second region.

17. A winding drum as claimed in claim 15 including means for releasably clamping said drum to a shaft inserted in said axial bore, and receiving means for cooperation with a torquing tool to effect angular rotation of said drum about said shaft when said clamping means is released, such that in use the pair of cables can be wound onto or unwound from the drum without rotation of the shaft.

18. A winding drum as claimed in claim 17 wherein said receiving means is formed on a collar that is integral with said drum and comprises a plurality of angularly spaced sockets extending in radial directions in said collar.

* * * * *